US010376946B1

(12) United States Patent
Ealer, Sr.

(10) Patent No.: US 10,376,946 B1
(45) Date of Patent: Aug. 13, 2019

(54) SYSTEM AND METHOD OF MAKING AN EXPANDED METAL GUTTER COVER HAVING A SOLID EDGE MARGIN

(71) Applicant: James E. Ealer, Sr., St. Clair, MO (US)

(72) Inventor: James E. Ealer, Sr., St. Clair, MO (US)

( * ) Notice: Subject to any disclaimer, the term of this patent is extended or adjusted under 35 U.S.C. 154(b) by 348 days.

(21) Appl. No.: 15/164,184

(22) Filed: May 25, 2016

(51) Int. Cl.
*B21D 47/00* (2006.01)
*E04D 13/064* (2006.01)
*E04D 13/076* (2006.01)

(52) U.S. Cl.
CPC ..... *B21D 47/005* (2013.01); *E04D 13/064* (2013.01); *E04D 13/076* (2013.01)

(58) Field of Classification Search
CPC .... B21D 47/005; E04D 13/076; E04D 13/064
See application file for complete search history.

(56) References Cited

U.S. PATENT DOCUMENTS 3,455,005 A * 7/1969 Mentis ..... B21D 47/005 29/522.1
3,889,345 A * 6/1975 Hirschberg ..... B21D 47/005 226/196.1
2016/0040302 A1* 2/2016 Mojana ..... C23F 13/10 205/734

* cited by examiner

*Primary Examiner* — Moshe Wilensky
(74) *Attorney, Agent, or Firm* — Stinson LLP

(57) ABSTRACT

A system and method of making a one-piece expanded metal gutter cover having a solid edge margin is disclosed. The system and method involves feeding a continuous web of solid metal to an expanding station, expanding the continuous web at the expanding station to form an expanded web of material having a screen section of expanded metal and a solid section of non-expanded metal, cutting the continuous web to form a gutter cover blank having screen and solid sections, and slitting the solid section of the gutter cover blank to remove a wavy side edge of the blank and create a substantially straight side edge extending along the blank. A system for carrying out this method is also disclosed.

5 Claims, 7 Drawing Sheets

SYSTEM AND METHOD OF MAKING AN EXPANDED METAL GUTTER COVER HAVING A SOLID EDGE MARGIN

BACKGROUND OF THE INVENTION

This invention relates generally to gutter covers, and more particularly to an improved system and method of making an expanded metal gutter cover having a solid edge margin.

FIGS. 1-3 illustrate a prior art system for making a solid-edge expanded metal gutter cover. In this system a coil 10 of sheet metal having a width W1 is used to make finished gutter covers 12 having a length L1 substantially equal to the coil width W1. The system includes expanding apparatus 14 which expands a continuous web 16 of sheet metal unwound from the coil 10. The apparatus 14 advances the web 16 a first distance D1 while expanding the metal to form an expanded metal section 18 having an open mesh of strands 20 (see FIG. 2) defining diamond-shaped openings 26 each of which has a long axis dimension LD extending widthwise of the web 16 and a short axis dimension SD extending lengthwise of the web. The apparatus 14 also advances the web a second distance D2 without expanding the metal, thereby creating a section 30 of solid metal extending across the web adjacent the expanded metal section 18. (The solid section 30 may be referred to as a solid edge margin of the web.) After the solid metal section is formed, the apparatus 14 cuts the web 16 along a cut line 34 extending across the web to create a gutter cover blank 36 that includes the expanded metal section 18 and the solid metal section 30. (The solid section 30 of the blank 36 may be referred to as a solid edge margin.) This cutting operation creates a wavy (e.g., uneven, undulating, irregular) side edge 40 along the blank which is removed later in the process, as will be described.

After the expansion step, each blank 36 is individually fed lengthwise (end first) to a flattening (leveling) apparatus 50 that flattens the blank and makes it substantially planar by removing any curves in the blank that may have been created by prior processing.

After the flattening operation, each flattened blank 36 is individually fed widthwise (long side first) into a shearing apparatus 60 having a shearing blade 62 longer than the length of the blank. The blade 62 operates to shear the blank 36 along a shear line 64 extending lengthwise of the blank and through the solid section of the blank to remove the wavy edge 40 and create a substantially flat straight edge 66 along a side of the blank 36 corresponding to the front side of a finished gutter cover.

After the shearing operation, each blank 36 is individually fed lengthwise (end first) into a roll forming apparatus 70 to give the blank a gutter cover configuration suitable for fitting a gutter. By way of example, the roll-forming apparatus may give the front side of the gutter the front formation 72 illustrated in FIG. 3 for engaging a horizontal flange extending rearward from the upper end of a front wall of a gutter.

The above prior art method is slow in part due to the shearing step performed by the shearing apparatus 60. The gutter cover blanks 36 must be hand fed into the apparatus 60, and the blank must be sheared and removed from the apparatus before the next blank can be loaded into the machine. This takes substantial time. Further, the operator's hands are relatively close to the shearing blade 62 of the apparatus 60 when the blanks are loaded and unloaded, which presents safety risks.

There is, therefore, a need for an improved method of making an expanded metal gutter cover having a solid edge margin.

SUMMARY OF THE INVENTION

This invention is directed to a method of making a one-piece expanded metal gutter cover having a length, a width, and at least one solid edge margin extending along the gutter cover at one side of the gutter cover. The method comprises the steps of feeding a continuous web of solid metal to an expanding station, expanding the continuous web at the expanding station to form an expanded web of material having a screen section of expanded metal extending across the web and a solid section of non-expanded metal extending across the web adjacent the screen section, and cutting the continuous web along a cut line extending across the web to form a gutter cover blank having a length extending widthwise of the continuous web and a width extending lengthwise of the continuous web. The gutter cover blank includes the screen section and the solid section and has a wavy side edge created by cutting the continuous web along the cut line. The method further comprises the step of slitting the solid section of the gutter cover blank as the gutter cover blank moves continuously in the direction of its length to remove the wavy side edge and create a substantially straight side edge extending along the gutter cover blank.

This invention is also directed to a system for carrying out the aforesaid method. The system comprises apparatus for expanding a continuous web of metal to form an expanded web having a screen section of expanded metal extending across the web and a solid section of non-expanded metal extending across the web adjacent the screen section, and at least one blade for cutting the continuous web along a cut line extending across the web to form a gutter cover blank having a length extending widthwise of the continuous web and a width extending lengthwise of the continuous web. The gutter cover blank includes the screen section and the solid section. The gutter cover blank has a wavy side edge created by cutting the continuous web along the cut line. The system further comprises apparatus for slitting the solid section of the gutter cover blank as the gutter cover blank moves continuously in the direction of its length to remove the wavy side edge and create a substantially straight side edge extending along the gutter cover blank.

Other features of the present invention will be in part apparent and in part pointed out hereinafter.

BRIEF DESCRIPTION OF THE DRAWINGS

Corresponding parts are designated by corresponding reference numbers throughout the drawings.

DESCRIPTION OF PREFERRED EMBODIMENTS

Figure 1:
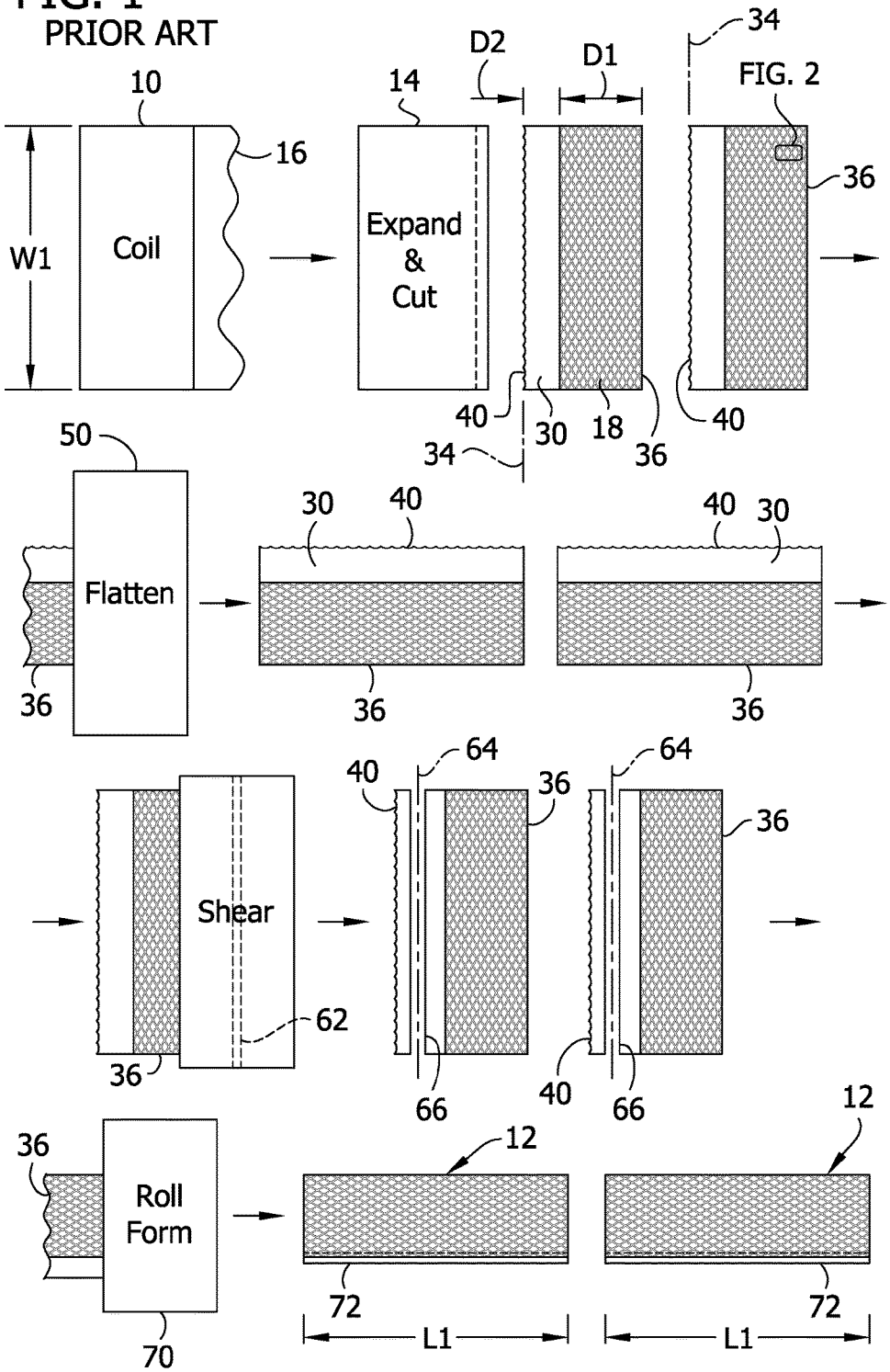
FIG. 1 PRIOR ART
FIG. 1 is a schematic illustration of a prior art system and method of making expanded metal gutter covers with solid edge margins.
Figure 2:
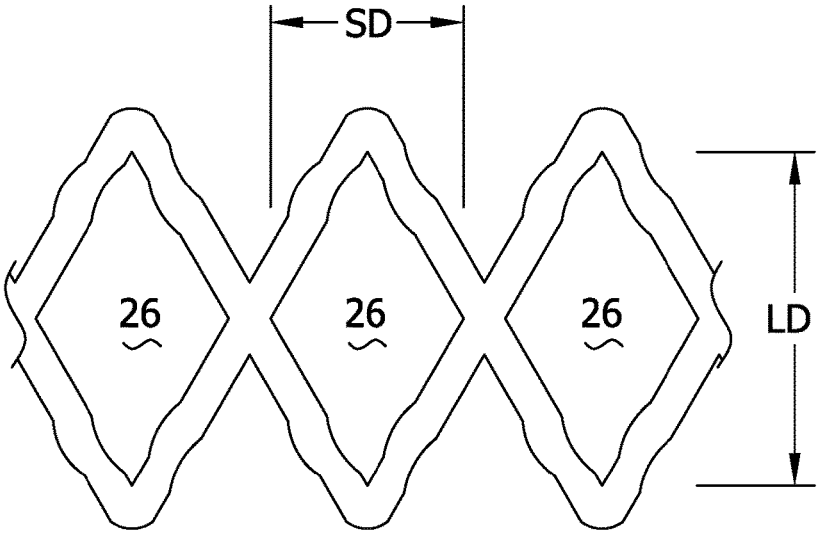
FIG. 2 PRIOR ART
FIG. 2 is an enlarged view of an expanded metal portion from a gutter cover blank of FIG. 1.
Figure 3:
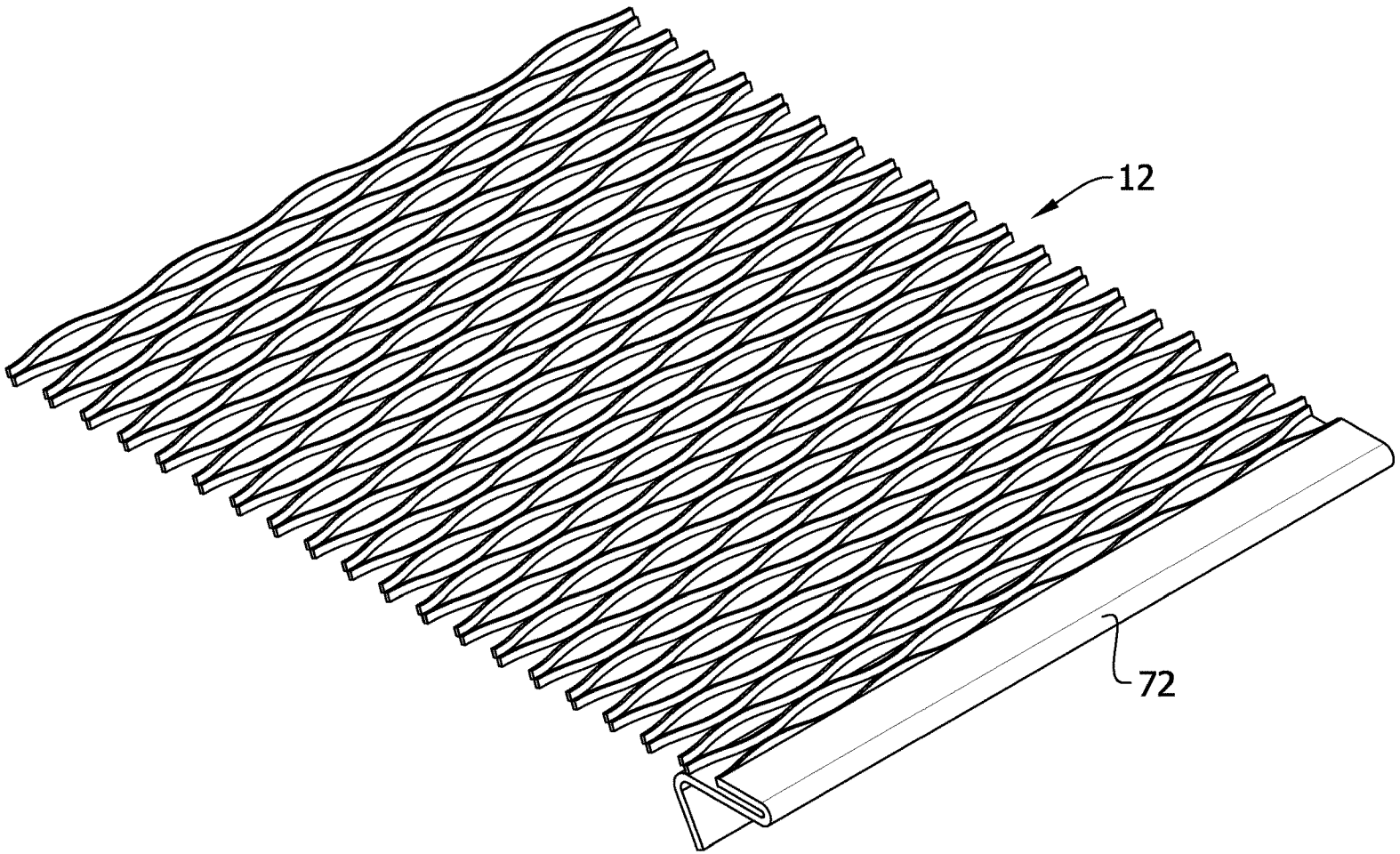
FIG. 3 PRIOR ART
FIG. 3 is a front perspective of a gutter cover made using the prior art system and method.
Figure 4:
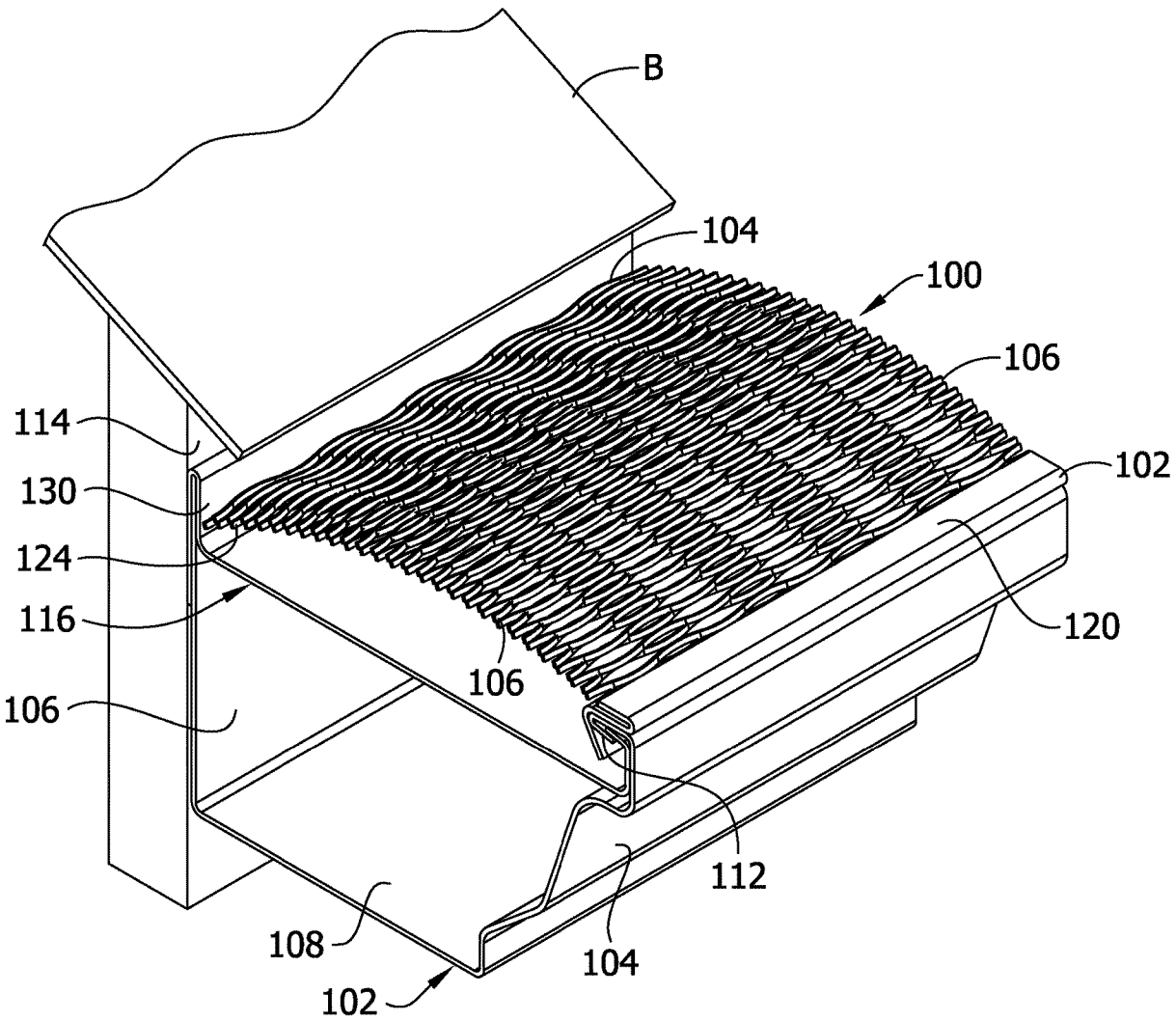
FIG. 4 is a perspective of the gutter cover of FIG. 3 mounted on a gutter.

A system and method of my invention involves the manufacture of an expanded metal gutter cover having a solid edge margin. FIG. 4 illustrates an exemplary embodiment of one such gutter cover, which is designated in its entirety by the reference numeral 100. The gutter cover 100 is particularly adapted for covering a conventional rain gutter, such as indicated generally at 102, to prevent leaves, debris and the like from falling into the gutter. The gutter 102 has a front wall 104, a back wall 106 and a bottom wall 108, which combine to form a channel 110 for drainage of rainwater. The front wall 104 may be provided with a decorative and/or strengthening configuration, as shown. A conventional lip or flange 112 projects rearward from the front wall 104 of the gutter adjacent its upper end and is spaced above the bottom wall 108 of the gutter 102. The gutter 102 is suitably attached to the outside wall 114 of a building B, such as by gutter hangers, one of which is shown and generally designated 116.

Figure 5:
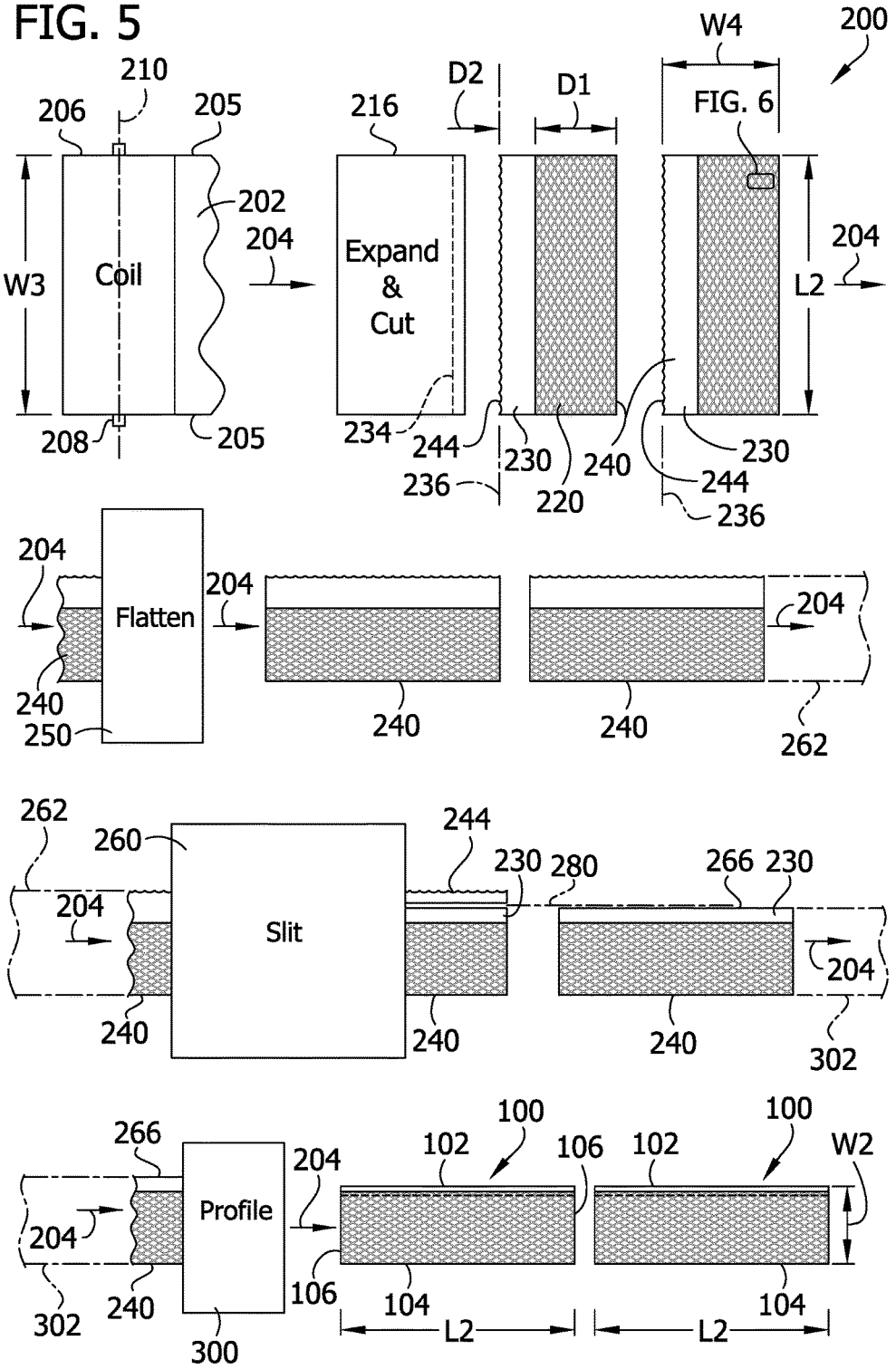
FIG. 5 is a schematic illustration of my new system and method of making expanded metal gutter covers with solid edge margins.
Figure 6:
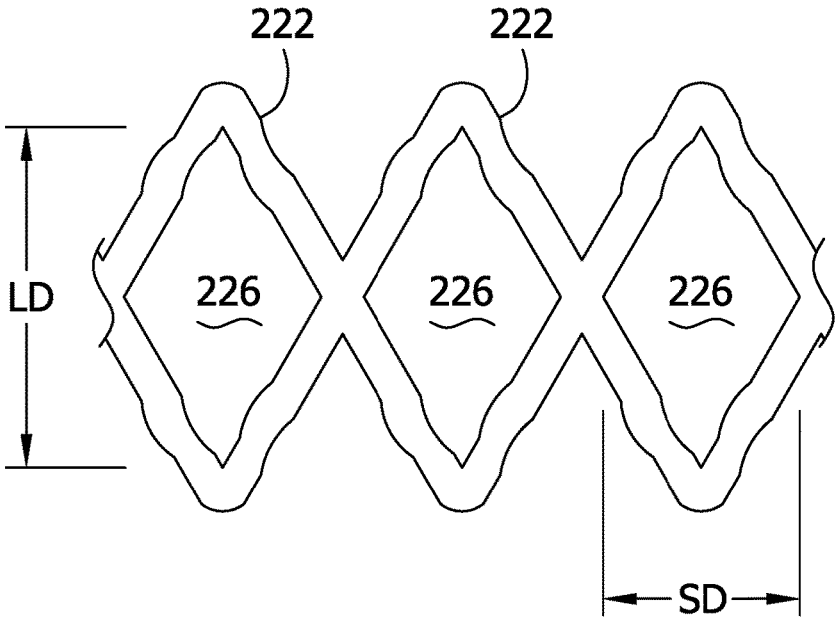
FIG. 6 is an enlarged view of an expanded metal portion from an expanded web of FIG. 5.

Referring to FIGS. 4 and 5, the gutter cover 100 is of one-piece construction and has a length L2, a width W2, a front side 102, a rear side 104, and opposite ends 106. The gutter cover 100 is formed of flexible resilient material (e.g., a metal such as an aluminum alloy or steel alloy) and is of integral construction, i.e., it is formed as a single one-piece part from a single continuous strip of such material. In the illustrated embodiment, the gutter cover 100 comprises expanded metal. The front edge margin 120 of the gutter cover along the front side 102 of the cover is of solid metal. Optionally, the rear edge margin 124 of the gutter cover 100 along the rear side 104 of the gutter cover may also be of solid metal. The solid metal strengthens the gutter cover 10, which allows a lighter, less expensive material such as aluminum alloy to be used. The rear side 104 of the gutter cover 100 is configured for engagement with a rear portion 130 of the gutter hanger 116, and the front side 102 is configured for engagement with the front of the gutter (the front flange 112 of the gutter as illustrated in FIG. 4). The gutter cover 100 may have other front and rear configurations.

FIGS. 5-8 illustrate an improved system 200 and method for making the gutter cover 100. In general, the system 200 includes apparatus 216 for expanding a continuous web 202 of solid material such as steel or aluminum, at least one blade 234 for cutting the web 202 to form gutter cover blanks 240 each having an expanded metal section and a solid metal section, apparatus 250 for flattening (leveling) the blanks 240, apparatus 260 for slitting the blanks 240, and apparatus 300 for profiling the blanks 240. Each of these elements is described in more detail below.

In particular, the system 200 operates to feed the continuous web 202 along a path 204, e.g., from left to right in FIG. 5. The web 202 has a length extending in the direction of feed (from left to right in FIG. 5), a width W3 extending transverse to the direction of feed, and opposite side edges 205 extending lengthwise of the web. The web 202 is fed from a supply 206 of such material. In the illustrated embodiment, the supply 206 is a coil mounted on a shaft 208 for rotation about an axis 210 extending generally transverse to the direction of feed. The web 202 is fed from the coil 206 in a direction extending lengthwise of the web in any suitable manner. By way of example, one or more powered feed rolls (not shown) may pull the web from the coil. Alternatively, the shaft 208 mounting the coil may be driven to feed or assist in the feeding of the web along the path 204.

The expanding apparatus 216 is provided along the path 204 for expanding the continuous web 202 in a lengthwise direction, that is, in a direction generally parallel to the length of the web. The apparatus 216 advances the web a first distance D1 while expanding the metal to form an expanded metal section 220 having an open mesh of strands 222 defining diamond-shaped openings 226 (see FIG. 6). Each opening 226 has a long axis dimension LD extending widthwise of the web 202 and a short axis dimension SD extending lengthwise of the web. In other embodiments, the openings 226 may have a different configuration, e.g., a long axis dimension LD extending lengthwise of the web 202 and a short axis dimension SD extending widthwise of the web, as described in my U.S. Pat. No. 8,146,218, incorporated herein by reference. The expanding apparatus 216 also advances the web a second distance D2 without expanding the metal, thereby creating a section 230 of solid metal extending across the web adjacent the expanded metal section 220 (see FIG. 5).

After the solid metal section 230 is formed, one or more cutting blades 234 operate to cut the web 202 along a cut line 236 extending across the web to create a gutter cover blank 240 that includes the expanded metal section 220 and the solid metal section 230. The gutter cover blank 240 has a length L2 extending widthwise of the continuous web 202 and a width W4 extending lengthwise of the continuous web. In the illustrated embodiment, the length L2 of the blank 240 generally corresponds to the length L2 of the finished gutter cover 100. The width W4 of the blank 240 is typically less than the width W2 of the finished gutter cover 100 due to slitting and profiling steps to be described hereinafter. In any event, the cutting operation performed by the one or more blades 234 typically creates a wavy side edge 244 along the blank 240 which is removed later in the process, as will be described. As used herein, the term "wavy" means any one or more of the following: irregular, uneven, undulating, or corrugated.

An exemplary expanding apparatus 216 is sold under the designation Bender SP-1250 by Bender GmbH & Co., located in Grunberg, Germany. In this apparatus the blade 234 is a saw-tooth tooth blade that moves in cycles to form the open mesh of strands 222 and diamond-shaped openings 226 as follows. In one such forming cycle, the blade moves down from a home position to perforate the web 202 and thereby form one-half of the expanded diamond pattern; the blade moves up to its home position; the blade moves laterally with respect to the web in one direction (e.g., to the right) the distance needed to make the required diamond pattern; the expanding apparatus 216 advances the web 202 a distance corresponding to one-half the width of the diamond expanded pattern; the blade moves down and perforates the web 202 to form the complete diamond pattern; the blade moves up; the blade moves laterally with respect to the web 202 in the opposite direction (e.g., to the left) back to its home position; and the expanding apparatus 216 again advances the web 202 a distance corresponding to one-half of the diamond pattern. The forming cycle then repeats and continues until one entire expanded metal section 220 having a width corresponding to distance D1 is formed. The expanding apparatus 216 then advances the web 202 a distance corresponding to D2 (without moving the blade) to create the solid metal section 230. When both sections 220 and 230 are completed, the blade 234 operates in a cutting or shearing cycle as follows: the blade moves down from its home position and cuts (shears) the web 202 along a first segment of the cut line 34; the blade returns to its home position and moves laterally with respect to the web 202 in one direction (e.g., to the right); the blade moves down and cuts (shears) the web 202 along a second and final segment of the cut line 34, which completely severs a gutter cover blank 36 from the web 202; and the blade 234 returns to its home position.

In the illustrated embodiment, the one or more cutting blades 234 are incorporated as an integral functional part of the expanding apparatus 216. In other embodiments, the one or more cutting blades may be part of an apparatus separate from (independent of) the expanding apparatus 216, and the shearing step performed by the cutting blade(s) may be performed downstream from the apparatus 216 at a location or station separate from the apparatus 216.

After the expansion and cutting steps, each gutter cover blank 240 is moved and loaded into the flattening apparatus 250 which operates to flatten the blank and make it substantially planar by removing any curves in the blank that may exist. In this regard, when the blank 240 is formed, it typically has a bowed or curved form as viewed from an end of the blank (i.e., the width side of the blank). The bow or curve needs to be reduced, so that the panel will lay flat if laid on a flat surface. This leveling or flattening is accomplished by using the flattening apparatus 250, which can be a standard leveling roll former having a series of rollers that engage the gutter cover blank 240. Desirably, but not necessarily, the blanks 240 are fed lengthwise (end first) into the flattening apparatus 250 and exit the flattening apparatus 250 in the same orientation (end first).

After the flattening (leveling) operation, each flattened blank 240 is fed lengthwise (end first) into the slitting apparatus 260. Desirably, one or more conveyors 262 are provided for conveying a series of blanks 240 along the path 204 as the blanks remain in the same (end first) orientation from the flattening apparatus 250 to the slitting apparatus 260, and for feeding the blanks in this same orientation automatically into the slitting apparatus. Alternatively, the feed from the flattening apparatus 250 to the slitting apparatus 260 may be a batch feed in which each blank 240 is transferred from flattening apparatus and manually fed into the slitting apparatus. In any event, the slitting apparatus 260 operates to slit the blank 240 as it moves continuously in the direction of its length to remove the wavy side edge 244 and create a substantially flat straight edge 266 along a side of the blank 240 corresponding to the front side 102 of a finished gutter cover 100.

Figure 7:
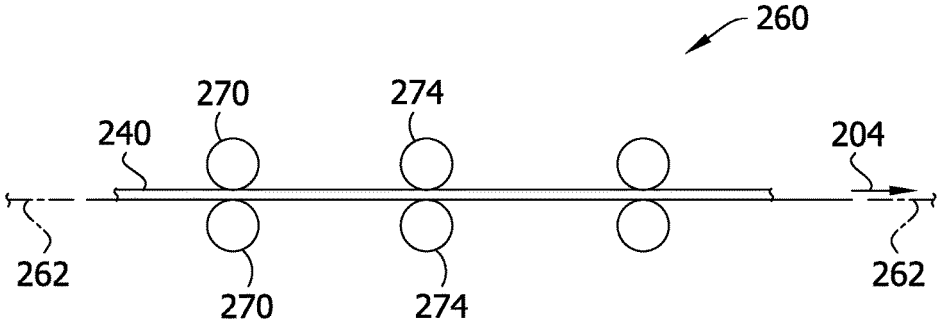
FIG. 7 is a schematic elevational view of exemplary slitting apparatus used in the method of FIG. 5.
Figure 8:
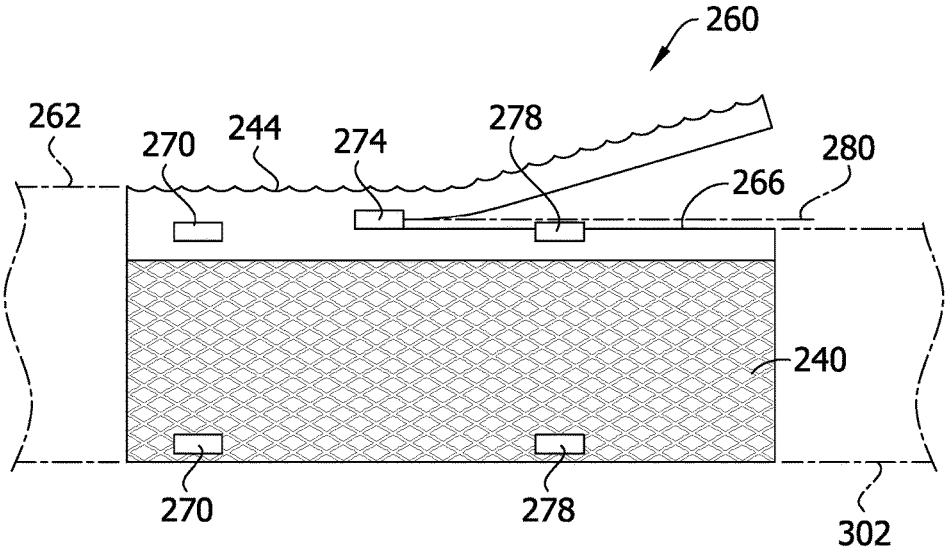
FIG. 8 is a schematic plan view of the slitting apparatus of FIG. 7.

Referring to FIGS. 7 and 8, the slitting apparatus 260 comprises upstream rollers 270, at least one slitting wheel 274 downstream from the upstream rollers, and exit rollers 278 downstream from the at least one slitting wheel. In the illustrated embodiment, the upstream rollers 270 include a first pair of opposing pinch rollers 270 adjacent one side of the gutter cover blank 240 and a second pair of opposing pinch rollers 270 adjacent the opposite side of the gutter cover blank 240. The upstream rollers 270 function to feed the blank 240 continuously in the direction of its length (end first) to the slitting wheel(s) 274. Two opposing slitting wheels 274 are illustrated in FIG. 7. The slitting wheels operate to cut the blank 240 along a cut line 280 extending lengthwise of the blank to remove the wavy side edge 244 and create the desired flat and straight edge 266 of the solid edge margin 230. The exit rollers 278 include a first pair of opposing pinch rollers 278 adjacent one side of the gutter cover blank 240 and a second pair of opposing pinch rollers 278 adjacent the opposite side of the gutter cover blank 240. The exit rollers 278 function to feed the blank 240 out of the slitting apparatus 260. Other types of slitting apparatus may be used. One suitable slitting apparatus is sold under the trade designation Tin Knocker 2024 slitter by Sheet Metal Equipment Sales Inc. located at 2132 Riverview Drive, Green Bay, Wis. 54303.

After the slitting operation, each blank 240 is fed lengthwise (end first) into the profiling apparatus 300, as illustrated in FIG. 5. Desirably, one or more conveyors 302 are used for conveying the blanks 240 along the path 204 as they remain the same (end first) orientation from the slitting apparatus 260 to the profiling apparatus 300, and for feeding the blanks in this same orientation automatically into the profiling apparatus. Alternatively, the feed from the slitting apparatus 260 to the profiling apparatus 300 may be a batch feed in which each blank 240 is transferred from slitting apparatus and manually fed to the profiling apparatus 300. In any event, the profiling apparatus 300 operates to give the blank 240 a gutter cover profile suitable for fitting a gutter, such as the profile illustrated in FIG. 4. By way of example but not limitation, the profiling apparatus 300 may be the one described in FIG. 28 and related text of my aforesaid U.S. Pat. No. 8,146,218, incorporated herein by reference.

It will be observed that in the system and method described above, it is desirable (but not necessary) that the flattening, slitting, and profiling steps are performed "in line", that is, the blanks 240 remain in the same orientation (end first in the illustrated embodiment) as they move along the path 204 from the flattening apparatus 250 to the slitting apparatus 260 and then to the profiling apparatus 300. A conventional conveyor system comprising one or more conveyors (e.g., conveyors 262, 302) may be used for feeding the gutter cover blanks along respective continuous segments of the path 204, that is, the segments of the path 204 from the flattening apparatus 250 to the slitting apparatus 260 and to the profiling apparatus 300. By way of example but not limitation, the conveyors may comprise a plurality of trays, e.g., a first tray positioned between the flattening apparatus 250 and the slitting apparatus 260, and a second tray positioned between the slitting apparatus and the profiling apparatus 300. In one embodiment, each tray is generally channel-shaped with a floor and upstanding sides extending parallel to the direction of conveyance. Desirably, the tray has a width between upstanding sides slightly greater than the width W4 of a gutter cover blank 240 and a length somewhat greater than the length L2 of the blank. The blanks 240 are moved along the floors of the trays by rotating drive wheels located above the floors generally along the centerlines of the trays. The drive wheels engage the blanks 240 and positively feed them into respective apparatus 250, 260, 300 without the need of having a person manually feed the blanks into the apparatus. Other types of conveyors may be used.

The in-line nature of the process described above is advantageous because it permits the flattening, slitting, and profiling steps to be completed using only one production line, unlike the prior art "batch" process described above in which the blanks are fed in different orientations (side first and end first) to the respective apparatus. Using an in-line process allows for more efficient production and results in gutter covers which are more uniform, resulting in fewer defective parts to be scrapped.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description or shown in the accompanying drawings shall be interpreted as illustrative and not in a limiting sense. For example, the various gutter screen profiles shown herein can be installed over the gutter in a variety of ways.

What is claimed is:

1. A system for making a one-piece expanded metal gutter cover having a length, a width, and at least one solid edge margin extending along the gutter cover at one side of the gutter cover, said system comprising apparatus for expanding a continuous web of metal to form an expanded web having a screen section of expanded metal extending across the web and a solid section of non-expanded metal extending across the web adjacent the screen section, at least one blade for cutting the continuous web along a cut line extending across the web to form a gutter cover blank having a length extending widthwise of the continuous web and a width extending lengthwise of the continuous web, the gutter cover blank including said screen section and said solid section, the gutter cover blank having a wavy side edge created by cutting the continuous web along said cut line, and slitting apparatus configured to slit the solid section of the gutter cover blank as the gutter cover blank moves continuously in the direction of its length to remove said wavy side edge and create a substantially straight side edge extending along the gutter cover blank;

wherein the at least one blade is configured to cut the continuous web along a plurality of cut lines that are spaced apart lengthwise of the continuous web to form a plurality of gutter cover blanks, each of the cut lines extending across the web to form a respective one of the plurality of gutter cover blanks;

wherein each of the plurality of gutter cover blanks has a length extending widthwise of the continuous web and a width extending lengthwise of the continuous web, wherein each of the plurality of gutter cover blanks includes said screen section and said solid section, and wherein each of the plurality of gutter cover blanks has a wavy side edge created by cutting the continuous web along the respective cut line; and wherein the slitting apparatus is configured such that the plurality of gutter cover blanks is moved in series through the slitting apparatus.

2. The system of claim 1, further comprising apparatus for flattening the gutter cover blank before the gutter cover blank is slit.

3. The system of claim 2, further comprising profiling apparatus for forming the gutter cover blank to have a gutter cover profile after the gutter cover blank is slit.

4. The system of claim 3, further comprising one or more conveyors for conveying the gutter cover blank as it remains in one orientation from the flattening apparatus to the slitting apparatus and then to the profiling apparatus.

5. The system of claim 1, the slitting apparatus is configured to slit each of the plurality of gutter cover blanks individually as the gutter cover blank moves continuously in the direction of its length to remove said respective wavy side edge and create a respective substantially straight side edge extending along the gutter cover blank.

* * * * *